US007045220B2

(12) United States Patent
Ishiduka et al.

(10) Patent No.: US 7,045,220 B2
(45) Date of Patent: May 16, 2006

(54) METAL CASTING FABRICATION METHOD

(75) Inventors: Masanobu Ishiduka, Kawasaki (JP); Kouta Nishii, Kawasaki (JP); Noriyasu Aso, Kawasaki (JP); Koichi Kimura, Kawasaki (JP); Takayuki Fujiwara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/930,798

(22) Filed: Sep. 1, 2004

(65) Prior Publication Data

US 2005/0037215 A1 Feb. 17, 2005

Related U.S. Application Data

(62) Division of application No. 10/161,596, filed on Jun. 5, 2002, now Pat. No. 6,820,678.

(30) Foreign Application Priority Data

Jun. 14, 2001 (JP) ..... 2001-179830
Aug. 3, 2001 (JP) ..... 2001-236008
Nov. 29, 2001 (JP) ..... 2001-363945

(51) Int. Cl.
*B32B 15/04* (2006.01)
*B32B 15/08* (2006.01)
*H05K 5/04* (2006.01)

(52) U.S. Cl. ..... 428/614; 428/621; 428/626; 428/632; 428/600; 428/469; 361/600; 455/90.3; 455/575.1; 174/50

(58) Field of Classification Search ..... 428/608, 428/614, 627, 632, 633, 621, 650
See application file for complete search history.

(56) References Cited

U.S. PATENT DOCUMENTS

| | | | | |
|---|---|---|---|---|
| 3,949,552 | A * | 4/1976 | Kaneko et al. | 60/282 |
| 4,546,048 | A * | 10/1985 | Guenther | 428/608 |
| 4,755,437 | A | 7/1988 | Sabatie et al. | 428/614 |
| 4,832,106 | A | 5/1989 | Bucking et al. | 164/98 |
| 5,293,923 | A | 3/1994 | Alabi | 164/102 |
| 5,404,639 | A * | 4/1995 | Guenther | 29/888.61 |
| 5,616,421 | A * | 4/1997 | Sawtell et al. | 428/614 |
| 5,819,858 | A * | 10/1998 | Nechansky | 174/252 |
| 5,875,830 | A | 3/1999 | Singer et al. | 164/19 |
| 5,981,085 | A * | 11/1999 | Ninomiya et al. | 428/614 |
| 6,245,442 | B1 * | 6/2001 | Towata et al. | 428/614 |
| 6,296,045 | B1 | 10/2001 | Fox et al. | 164/98 |
| 6,428,907 | B1 * | 8/2002 | Mehdianpour et al. | 428/613 |
| 6,520,242 | B1 | 2/2003 | Ruhland | 164/97 |
| 6,619,369 | B1 | 9/2003 | Takayanagi | 164/55.1 |
| 6,648,055 | B1 | 11/2003 | Haug et al. | 164/98 |

FOREIGN PATENT DOCUMENTS

| | | |
|---|---|---|
| EP | 0 799 901 A1 | 10/1997 |
| GB | 2 203 681 A | 10/1988 |

(Continued)

*Primary Examiner*—John J. Zimmerman
(74) *Attorney, Agent, or Firm*—Armstrong, Kratz, Quintos, Hanson & Brooks, LLP

(57) ABSTRACT

A metal casting fabrication method is provided. In accordance with the method, first a metal plate is disposed in the cavity of molding dies. This metal plate includes a first surface formed with a heat insulating layer, and a second surface opposite to the first surface. With the metal plate placed in the cavity, the heat insulating layer is held in contact with the dies, while the opposite or second surface is partially exposed to the cavity. The injected molten metal properly fills the cavity from end to end since its heat is not conducted unduly to the dies via the metal plate.

6 Claims, 15 Drawing Sheets

FOREIGN PATENT DOCUMENTS

| | | |
|---|---|---|
| JP | 5-177333 | 7/1993 |
| JP | 7-255607 | 10/1995 |
| JP | 8-124664 | 5/1996 |
| JP | 9-272945 | 10/1997 |
| JP | 11-104798 | 4/1999 |
| JP | 2000-223855 | 8/2000 |

* cited by examiner

METAL CASTING FABRICATION METHOD

This application is a divisional of prior application Ser. No. 10/161,596, filed Jun. 5, 2002, now U.S. Pat. No. 6, 820,678.

BACKGROUND OF THE INVENTION

1. Field of the Invention

The present invention relates to a metal casting fabrication method applicable for forming a metal housing of a notebook computer, a mobile telephone or the like. The present invention also relates to a metal casting produced by such a method.

2. Description of the Related Art

Mobile devices such as notebook computers and cellular phones should not weight very much. For the purposes of reducing weight (and some other purposes as well), their housings may be made of lightweight metal such as magnesium alloy or aluminum alloy. Since great precision is possible, such a metal housing is often formed by die-casting, whereby molten metal is injected under pressure into a cavity ("die cavity") defined by dies, or molds. A forming technique by die-casting is disclosed in JP-A-9 (1997)-272945 for example.

Though great precision is attained, die-casting has a drawback as follows. Specifically, molten metal injected into the die cavity will harden by being cooled by the cold dies. The problem occurs when the die cavity includes a narrow portion (whose width is smaller than 1.5 mm for example). Since the narrow portion cools the molten metal quickly, the metal impelled into the narrow portion may harden prematurely before it fills the narrow portion. Accordingly, an unfilled space is left in the die cavity.

The above problem may be addressed by a method disclosed in JP-A-2000-223855. In accordance with the teaching of JP-A-2000-223855, a metal object including small-width portions is formed by the combination of a die-casting and a non-die-casting techniques. Specifically, a metal object to be produced may include a first narrow portion and a second narrow portion continuous with the first narrow portion. The second narrow portion has a smaller width than the first narrow portion. To produce this metal object, the second narrow portion is prepared beforehand, separately from the first narrow portion, by a non-die-casting technique. The obtained second narrow portion is placed in the die cavity. Then, molten metal is injected into the die cavity. As a result, the broader first narrow portion will be formed in contact with the inserted second narrow portion.

In the method of JP-A-2000-223855, however, the first narrow portion is still formed by die-casting. Therefore, the above-mentioned problem (the occurrence of an unfilled space) may result in the first narrow portion. Another problem is caused by the direct contact of the second narrow portion with the dies. In this contact arrangement, the heat of the molten metal dissipates easily via the second narrow portion. As a result, the mechanical properties of the first narrow portion fail to be uniform in a region thereof adjacent to the joint between the first and the second narrow portions. Disadvantageously, this makes unstable the connection of the first narrow portion to the second narrow portion.

JP-A-5(1993)-177333, JP-A-7(1995)-255607 and JP-A-11(1999)-104798 also teach methods whereby a metal member is inserted in the die cavity before injection of molten metal is performed. These techniques, however, have been proposed in view of improving the surface condition of magnesium alloy or aluminum alloy, which has poor heat and corrosion resistance, but not for the purposes of forming a thin-walled portion properly by die-casting.

SUMMARY OF THE INVENTION

The present invention has been proposed under the circumstances described above. It is, therefore, an object of the present invention to provide a metal casting fabrication method whereby a thin-walled portion is properly formed without suffering from the occurrence of an unfilled space in a die cavity. Another object of the present invention is to provide a metal casting produced by such a fabrication method.

According to a first aspect of the present invention, there is provided a metal casting fabrication method that includes the steps of: disposing a metal plate in dies for improving mold-filling properties of molten metal; and forming a casting, or molded member, by injecting the molten metal into the dies.

With such an arrangement, it is possible to prevent misruns that would otherwise happen in a thin-walled portion of the molding cavity during a die-casting process.

Preferably, the method of the present invention may further comprise the step of forming a heat insulating layer on a prescribed surface of the metal plate before the metal plate is disposed in the dies. After the heat insulating layer is formed, the metal plate is disposed in the molding dies in a manner such that the insulating layer is held in contact with the dies. With this arrangement, since the metal plate is thermally insulated from the dies, it is possible to prevent the heat of the injected molten metal from being wastefully conducted to the dies via the metal plate. Accordingly, the injected metal is allowed to maintain its flowability and can fill the molding cavity from end to end. In addition, upon coming into contact with the metal plate, the injected metal is not unduly cooled by the plate owing to the heat insulating layer. Accordingly, the resulting molded member ("casting") is stably attached to the metal plate. Preferably, at the casting-forming step, the molten metal may be brought into contact with a second surface of the metal plate that is opposite to the above-mentioned first surface (upon which the heat insulating layer is formed), so that the casting is reliably fixed to the metal plate.

Preferably, the method of the present invention may further include the step of forming a bonding layer on the second surface of the metal plate before the plate-disposing step is performed. The bonding layer is designed to improve the bonding strength between the metal plate and the casting so that they are reliably fixed to each other.

The metal plate to be used for the present invention may be made of a light metal (whose density is no greater than 5 g/cm$^3$) such as aluminum, magnesium and titanium, or made of a light metal alloy based on these metals, so that the resulting metal casting can be small in weight. Preferably, the thickness of the metal plate to be used may be 0.1~1.0 mm.

According to the present invention, the molten metal to be used may be the above-mentioned light metals whose density is no greater than 5 g/cm$^3$, or light metal alloys. Preferably, the metal plate and the molten metal may have the same or common properties (in composition, main component, etc.), so that they are properly welded to each other. In addition, when the metal plate and the resulting molded member (casting) are made of the same or similar material, they exhibit the same or similar thermal properties. When the metal plate and the molded member have the same coefficient of thermal expansion for example, the final product composed of these elements will not be deformed unduly nor broken even in a heated atmosphere.

Preferably, the heat insulating layer may have a heat conductivity of 0.01~0.1 cal/(cm×deg×sec) for a temperature range of 300~600° C. Such a heat insulating layer may be made of aluminum oxide, silicon dioxide, or magnesium oxide. The heat conductivity of these elements is advantageously small (about one-tenth or even smaller than that of an ordinary metal).

Preferably, the heat insulating layer may be formed to cover the entirety of the first surface of the metal plate to reliably check the heat conduction from the molten metal to the dies. The thickness of the insulating layer may be 0.01~50 μm, more preferably 0.01~10 μm.

The heat insulating layer may be formed by spraying a heat insulator-dispersed liquid on the first surface of the metal plate. This dispersion liquid may be prepared by mixing powder of the above-mentioned metal oxide (average particle diameter of 0.01~2 μm) into a solvent (water or silicone oil for example) to the concentration of 5~15 wt %. The heat insulating layer may also be formed in the following manner. First, powder of the above-mentioned metal oxide (average particle diameter of 0.01~2 μm) is mixed with a resin binder, and this mixture is dissolved into an organic solvent (such as N-methyl-2-pyrrolidinone [NMP]) to the concentration of 5~15 wt %. Then, the obtained liquid is applied to the metal plate by spraying or brushing for example. Finally, the applied material is solidified at a prescribed curing temperature to provide the desired insulating layer. The resin binder to be used may be epoxy resin or polyimide resin. The curing temperatures for the epoxy resin and the polyimide resin may be 100° C. and 200° C., respectively. The insulating layer may also be formed by ceramic coating (e.g., vapor deposition [PDV or CVD] or thermal spraying) of a heat insulating material.

Preferably, the bonding layer may be formed by thermal spraying, plating or vapor deposition of a metal selected from a group of aluminum, magnesium, titanium and zinc. The bonding layer may also be formed by thermal spraying, vapor deposition, spin-coating, brush-application, etc., of a ceramic material.

Further, the bonding layer may be formed by applying a resin material to the second surface of the metal plate and then causing either one of a fibrous material and a porous material to be supported by the resin material. With such an arrangement, the molten metal flows into the fine structure of the fibrous or porous material. Thus, the resulting molded member (casting) can be strongly fixed to the metal plate. The bonding layer may be made of a resin material only. Preferably, the fibrous or porous material may be "reactive" to the molten metal. For instance, when magnesium is used as the molten metal, the fibrous (or porous) material is called as "reactive" when it causes the molten magnesium to undergo deoxidization. More specifically, when use is made of molten magnesium for the bonding layer containing silica, MgO or $Mg_2Si$ is produced by deoxidization, thereby providing a strong connection.

Preferably, the metal plate may be dissolved into the molten metal to cause depression of freezing point of the molten metal. To this end, the molten metal is injected into the dies at a temperature high enough to melt the metal plate.

With such an arrangement, the injected metal can stay in the molten state for a longer period of time than otherwise, so that it can fill the cavity without leaving any portion thereof unfilled. For lowering the freezing point of the molten metal, the metal plate may be made of aluminum, magnesium, zinc or tin for example, or made of an alloy containing one of these elements as the main component.

According to a second aspect of the present invention, there is provided a metal casting that includes: a metal plate provided with a first surface and a second surface opposite to the first surface; a heat insulating layer formed on the first surface of the plate; and a molded member attached at least to the second surface of the plate.

Preferably, the metal casting of the present invention may further include a boding layer disposed between the second surface of the plate and the molded member for the purposes of improving the bonding strength between the metal plate and the molded member.

Preferably, the heat insulating layer may dominantly contain a metal oxide selected from a group of aluminum oxide, silicon dioxide and magnesium oxide.

Preferably, the bonding layer may be made of a metal selected from a group of aluminum, magnesium, titanium and zinc, or made of a ceramic material. Preferably, the bonding layer may contain a resin material and either one of a fibrous material and a porous material attached to the resin material.

Preferably, the molded member may include a functional portion attached at least to the second surface of the plate. The functional portion may comprise a rib, a boss or a frame for example.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

FIGS. 1~4 illustrate a metal casting fabrication method according to a first embodiment of the present invention. In this embodiment, a housing component of an electronic device is produced.

Figure 1:
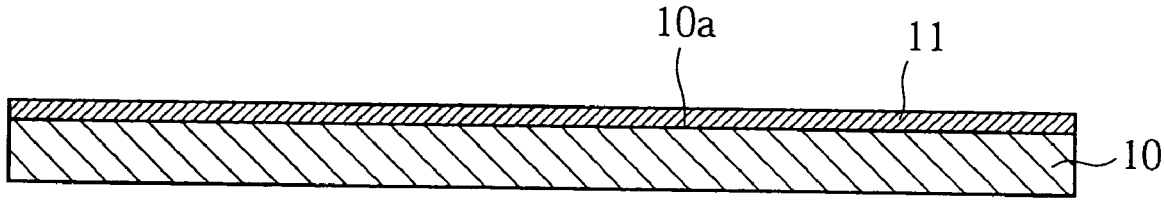
FIG. 1 is a sectional view showing a metal plate, with a heat insulating layer formed thereon, used for a metal casting fabrication method embodying the present invention.

FIG. 1 shows, in section, a metal plate 10 upon which a heat insulating layer 11 is formed. The illustrated plate 10 may be made of aluminum alloy, magnesium alloy or titanium alloy for attaining weight reduction. The insulating layer 11 extends over the entire surface. (first surface) 10*a* of the metal plate 10.

The insulating layer 11 may be made of a layer-forming material that contains aluminum oxide, silicon oxide or magnesium oxide whose weight-average diameter is in a range of 0.01~2 μm. The insulating layer 11 is formed by spraying dispersion liquid over the first surface 10*a* of the metal plate 10 and then blow-drying the applied liquid material. The dispersion liquid may contain 5~20 wt % of aluminum oxide or silicon oxide or magnesium oxide in water. The dispersion liquid may further have an addition of an adhesive agent (e.g. casein) for ensuring proper application of the heat insulating material to the metal plate. For the adhesive agent, use may also be made of a commercially available ceramic coating material such as "ARONCERAMIC" (by TOAGOSEI CO., LTD.) or "CERAMICA" (by NIPPAN KENKYUJO CO., LTD.). According to the present invention, no adhesive agent may be used, so that the insulating layer can be readily removed at the last stage of the fabrication procedure.

Figure 2:
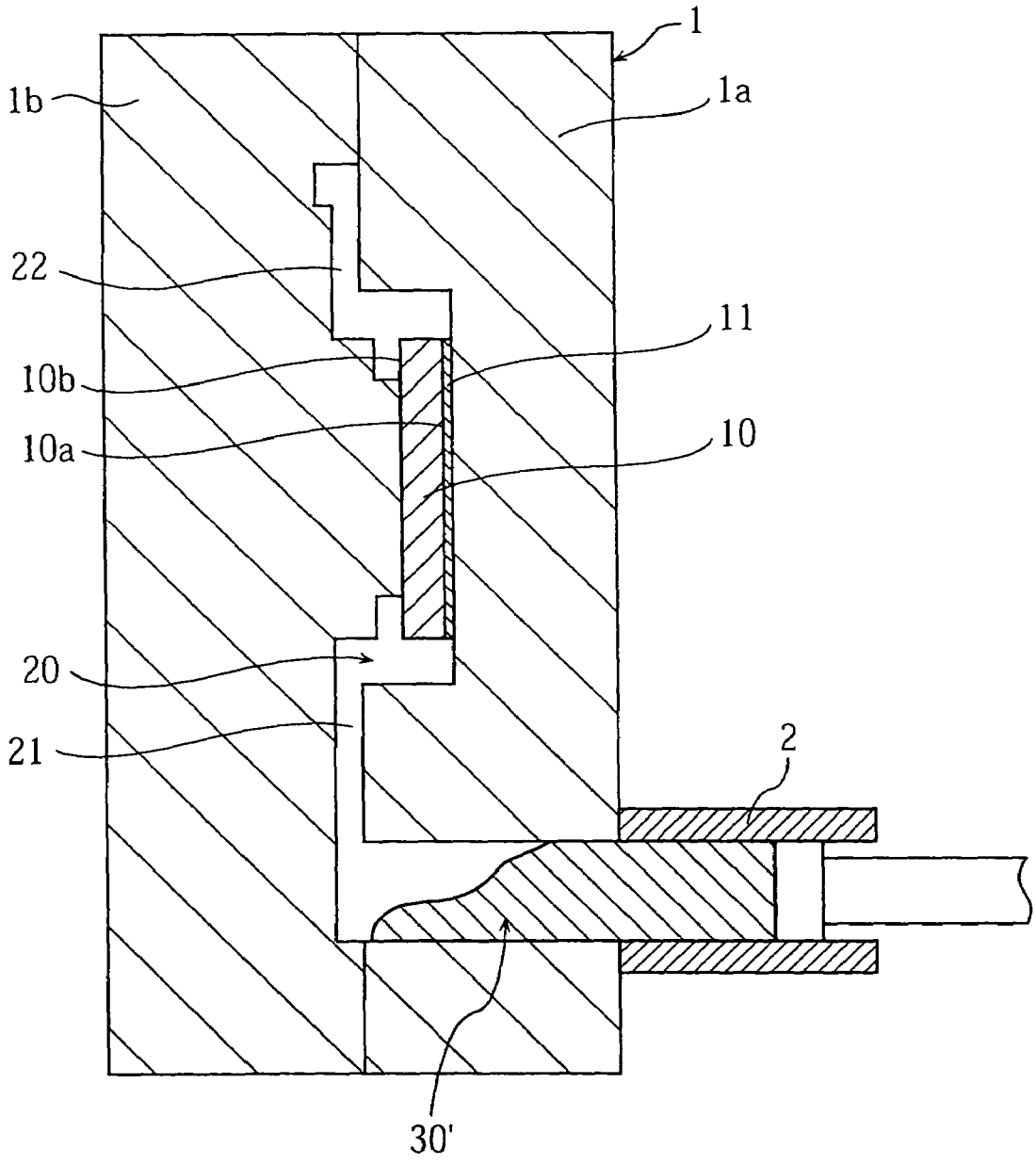
FIGS. 2~4 illustrate steps for making a metal casting of the present invention.

After the insulating layer 11 is formed, the metal plate 10 is clamped by dies 1, as shown in FIG. 2. The dies 1 include a stationary member 1*a* and a movable member 1*b* that can be moved toward or away from the stationary member 1*a*. When coming into contact with each other, the two members 1*a*, 1*b* define a die cavity 20 configured to produce the desired form of the metal casting. The cavity 20 includes a gate space 21 and an overflow space 22. The gate space 21 is provided for introducing the molten metal into the cavity 20. In the step of FIG. 2, the insulating layer 11 (formed on the first surface 10*a* of the metal plate 10) is held in contact with the dies 1, while the second surface 10*b* of the plate 10 that is opposite to the insulating layer 11 is partially exposed to the cavity 20. Molten metal 30' is provided in a casting sleeve 2.

Figure 3:
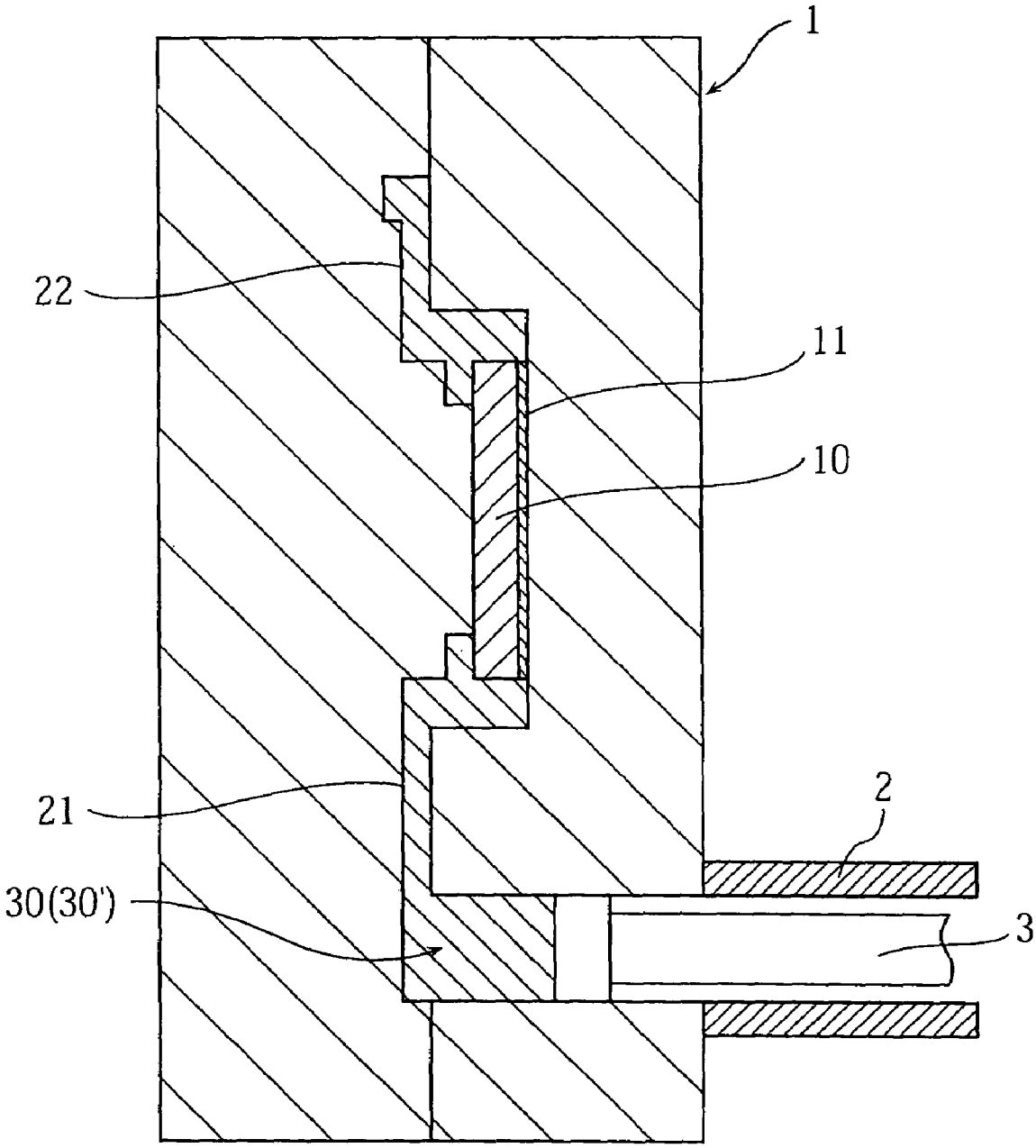

Then, as shown in FIG. 3, the molten metal 30' is injected under pressure into the cavity 20 by a plunger 3. At this time, the temperature of the dies 1 is kept between 150~300° C. in accordance with the kind of the metal 30'. The injected metal 30' reaches the metal plate 10 via the gate space 21. Thereafter, the molten metal 30' is impelled into the overflow space 22 via a passage (not shown) of the cavity 20. After the molten metal 30' fills the cavity 20, it is solidified, thereby providing a molded element ("casting" below) 30 incorporating the metal plate 10.

Figure 4:
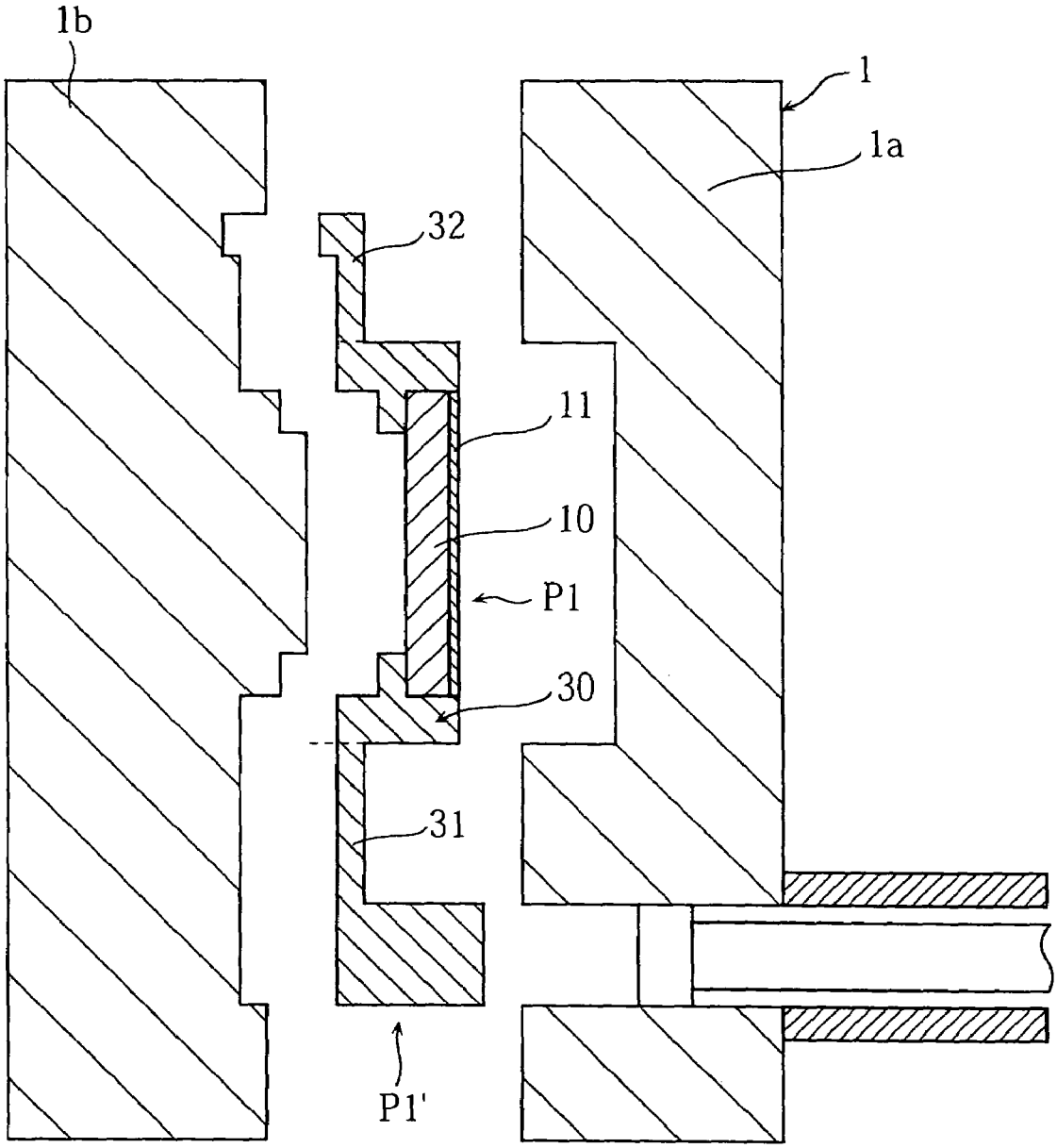

Referring to FIG. 4, after the casting 30 is appropriately cooled, the moveable member 1*b* is separated from the stationary member 1*a* to open the dies 1, so that the casting assembly P1' is taken out. At this stage, the casting 30 (welded to the metal plate 10) includes unnecessary portions 31 and 32 that correspond to the gate space 21 and the overflow space 22, respectively. These unnecessary portions are cut off at the prescribed points shown in broken lines, thereby producing the desired metal casting assembly P1.

Figure 5:
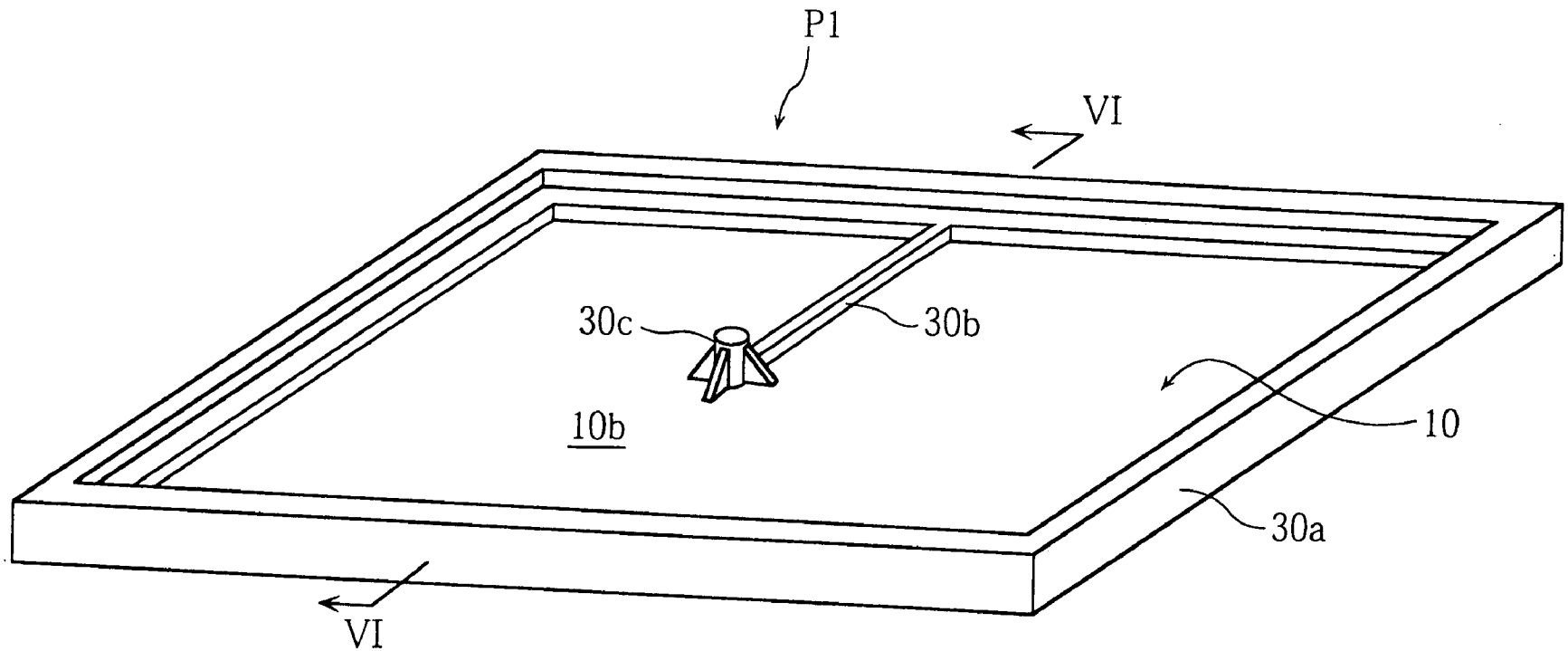
FIG. 5 is a perspective view showing the metal casting of the present invention.
Figure 6:
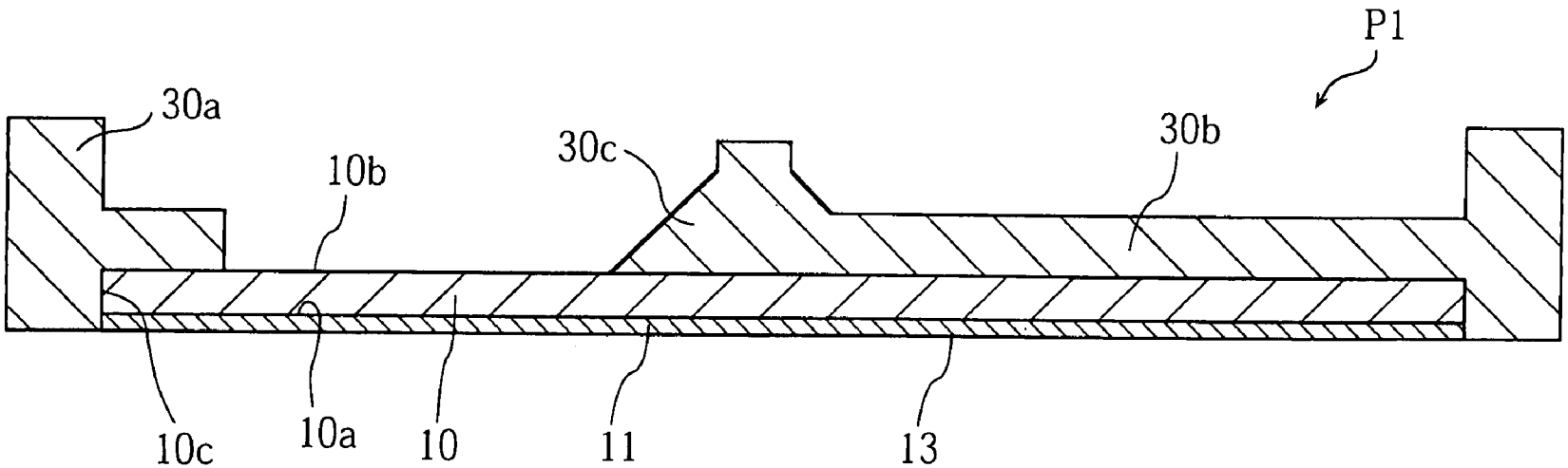
FIG. 6 is a sectional view taken along lines VI—VI in FIG. 5.

The overall view of the metal casting assembly P1 is shown in FIG. 5. FIG. 6 is a sectional view taken along lines VI—VI in FIG. 5. As seen from these figures, the casting assembly P1 includes the metal plate 10, the heat insulating plate 11 formed on the plate surface 10*a*, and the casting 30. As shown in the perspective view of FIG. 5, the casting 30 includes a rectangular frame 30*a* (enclosing the metal plate 10), a rib 30*b* and a boss 30*c*. For simplicity of illustration, the rib 30*b* and the boss 30*c* are not shown in FIGS. 2~4.

As shown in FIG. 6, the frame 30*a* is welded to the second surface 10*b* and side surfaces 10*c* of the metal plate 10, and serves as a wall for the casting assembly P1. The lower end surface of the frame 30*a* is flush with the exposed surface 13 of the insulating layer 11. The rib 30*b* and the boss 30*c* are welded to the second surface 10*b* of the metal plate 10. Though not shown in the figures, the boss 30*c* is formed with a bore for receiving a screw or a pin.

Reference is now made to FIGS. 7~10 illustrating a metal casting fabrication method according to a second embodiment of the present invention. In this embodiment again, the method will be described as being applicable to forming a housing component of an electronic device.

Figure 7:
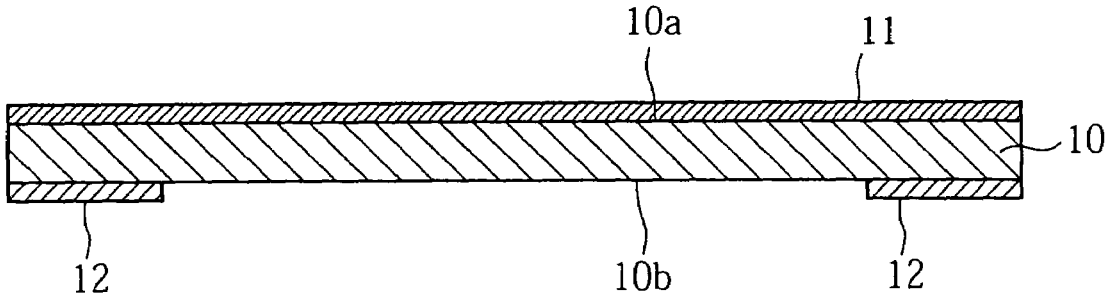
FIG. 7 is a sectional view showing a metal plate, with a heat insulating layer and a bonding layer formed thereon, used for another metal casting fabrication method embodying the present invention.
Figure 8:
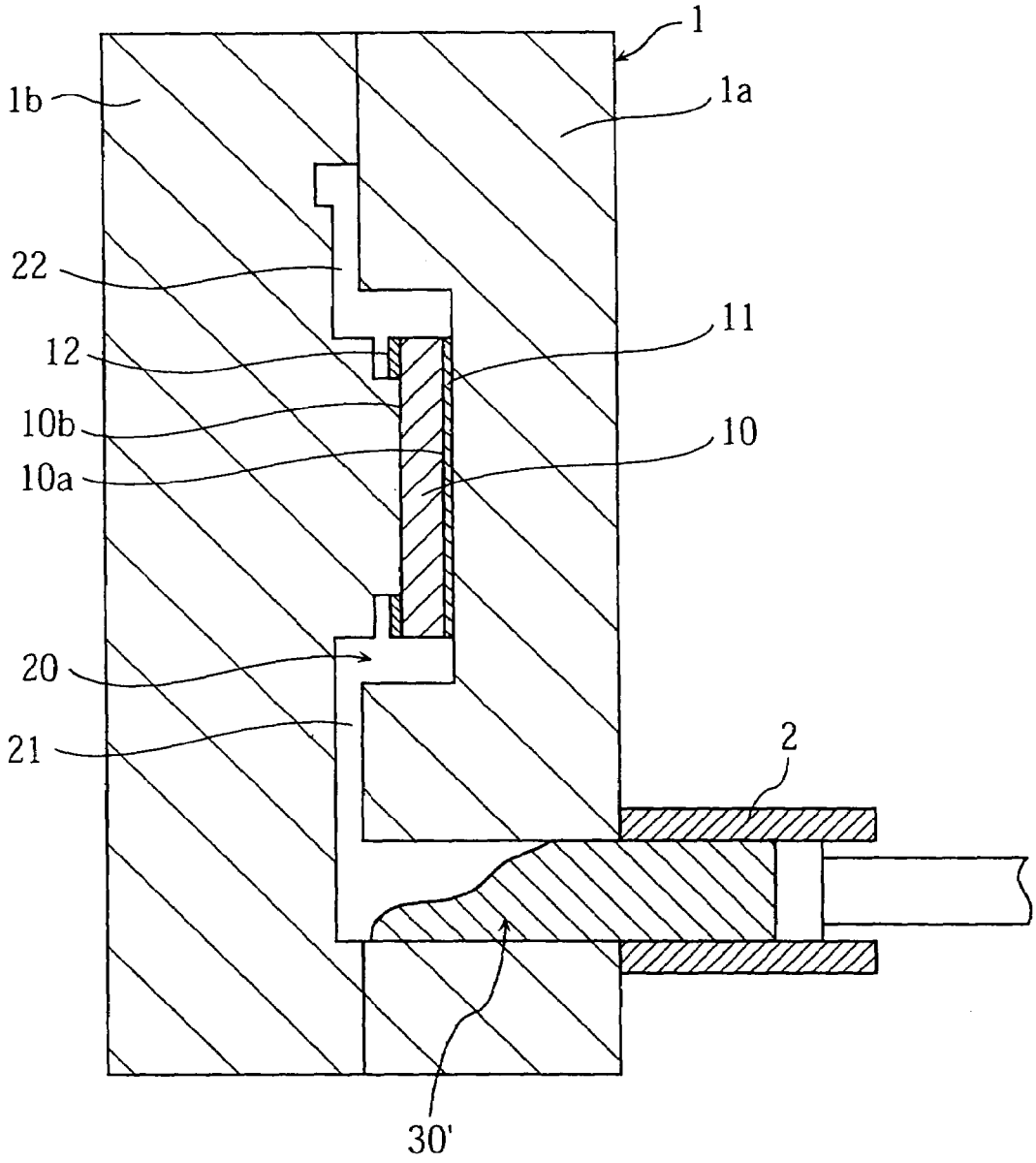
FIGS. 8~10 illustrate steps for making a metal casting of the present invention.

Referring to FIG. 7, a heat insulating layer 11 is formed on the first surface 10*a* of the metal plate 10, while a bonding layer 12 is formed on the second surface 10*b* of the plate 10. The layer 12 may be made by spraying, plating or vacuum evaporation of metal such as aluminum, magnesium, titanium and zinc. Alternatively, the adhesive layer 12 may be made by spraying, vacuum evaporation or embrocating of a ceramic material, or by applying a resin material over the second surface 10*b* and then causing a fibrous material or porous material to be attached to this resin layer. The porous material may be produced by sintering a mixture of ceramic particles and suitable binder. The ceramic particles may be alumina, silica, silicon carbide, or the like. The materials to be used for forming the metal plate 10 and the insulating layer 11 in the second embodiment may be the same as those used in the first embodiment. Also, the method of forming the insulating layer 11 in the second embodiment may be the same as that in the first embodiment Referring FIG. 8, after the layers 11 and 12 are formed, the metal plate 10 is clamped by the dies 1 in a manner such that the heat insulating layer 11 is held in contact with the dies 1, while the bonding layer 12 is exposed to the cavity 20. Molten metal 30' is provided in the casting sleeve 2.

Figure 9:
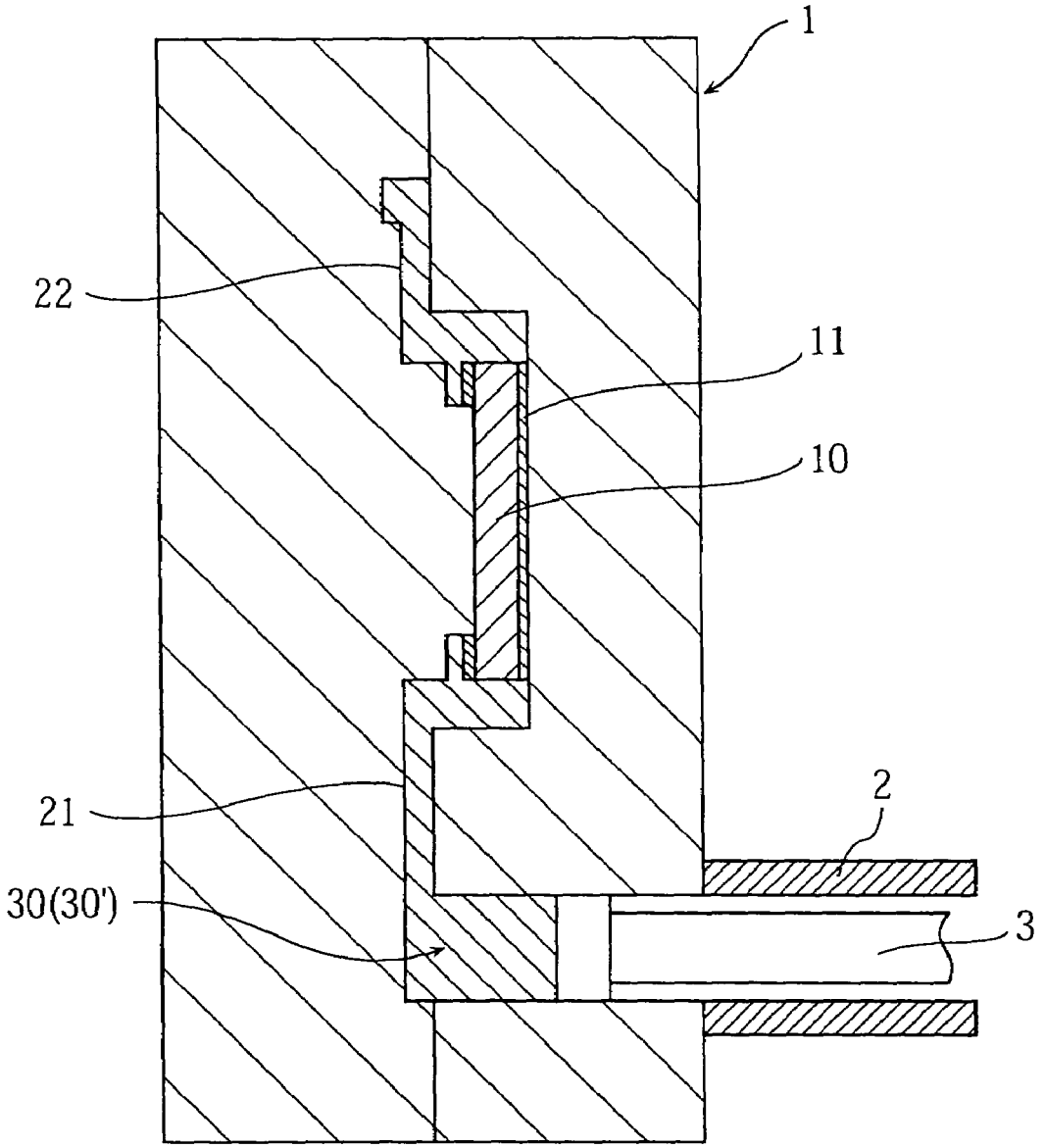

Then, as shown in FIG. 9, the molten metal 30' is injected under pressure into the cavity 20 by the plunger 3. At this stage, the temperature of the dies 1 is kept between 150~300° C. in accordance with the kind of the metal 30'. The injected molten metal 30' reaches the metal plate 10 via the gate space 21 of the cavity 20. Thereafter, the metal 30' is impelled into the overflow space 22 via the non-illustrated passage of the cavity 20. Then, the metal 30' is solidified, thereby providing a casting 30 incorporating the metal plate 10.

Figure 10:
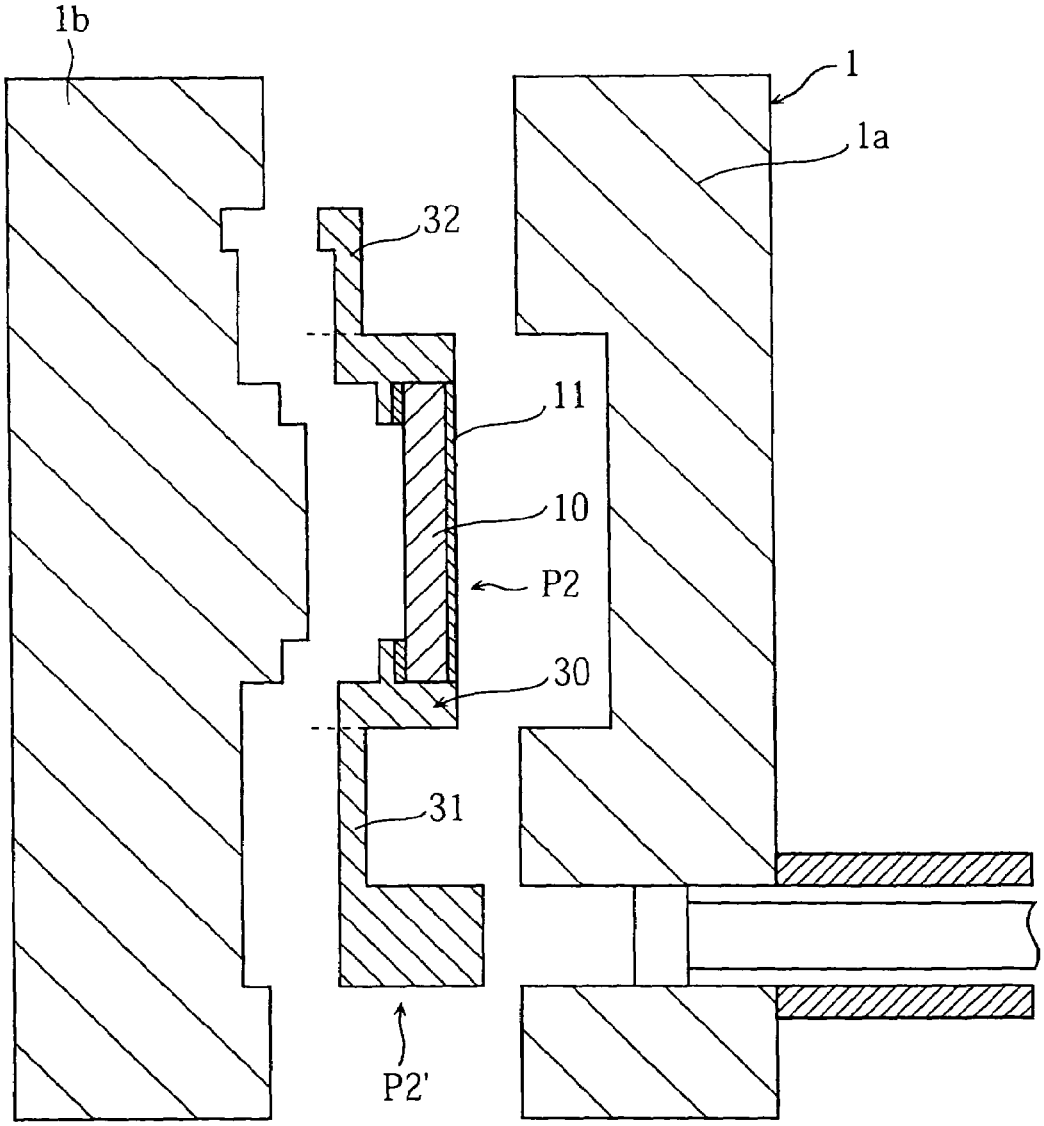

Referring to FIG. 10, after the casting 30 is sufficiently cooled, the dies 1 are opened by separating the movable member 1*b* from the stationary member 1*a*, so that the casting assembly P2' is taken out. At this stage, the casting 30 includes unnecessary portions 31 and 32 corresponding to the gate space 21 and the overflow space 22, respectively. These unnecessary portions are cut off at the prescribed points shown in broken lines, thereby producing the desired metal casting assembly P2.

Figure 11:
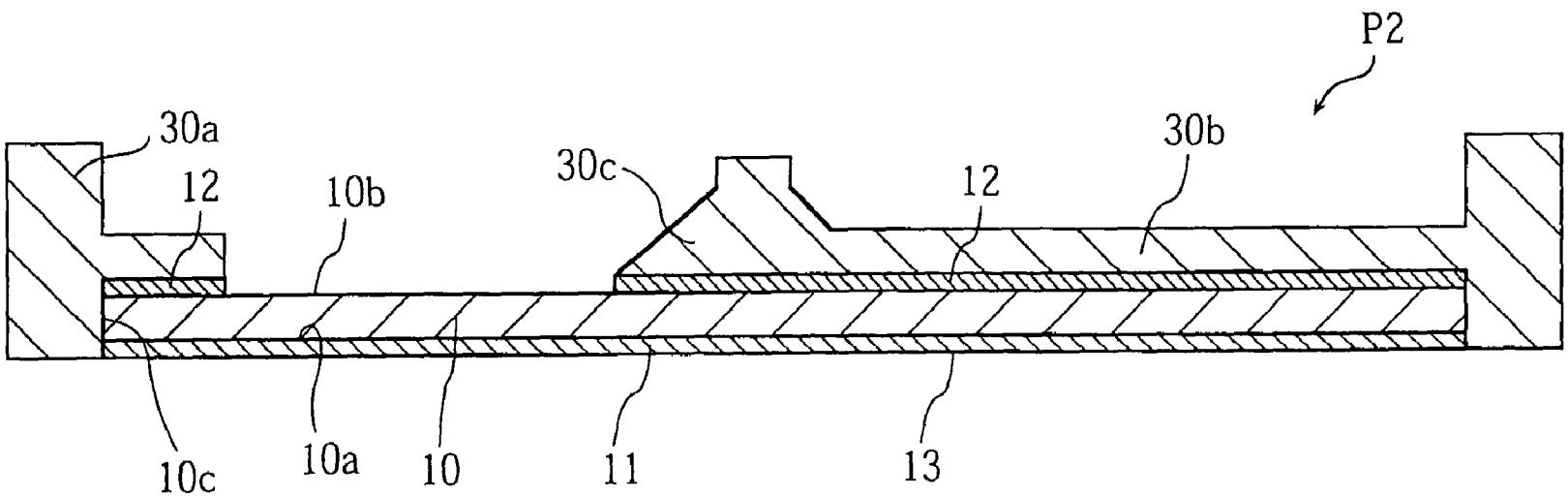
FIG. 11 is a sectional view showing the metal casting obtained by the second fabrication method.

FIG. 11 is a sectional view showing the above-described casting assembly P2. This section corresponds to that shown in FIG. 6, taken along lines VI—VI. The assembly P2 includes the metal plate 10, the heat insulating layer 11 (formed on the first surface 10*a* of the plate 10), the bonding layer 12 (formed on the second surface 10*b* of the plate 10) and the casting 30 fixed to the plate 10 via the bonding layer 12. The casting 30 includes a frame 30*a* surrounding the plate 10, a rib 30*b* and a boss 30*c*. The frame 30*a* is attached to the side surfaces 10*c* of the plate 10 and to the second surface 10*b* of the plate 10 via the bonding layer 12. The lower end surface of the frame 30*a* is flush with the exposed surface 13 of the insulating layer 11. The rib 30*b* and the boss 30*c* are attached to the second surface 10*b* via the bonding layer 12. The bonding layer 12 causes the frame 30*a*, the rib 30*b* and the boss 30*c* to be properly connected to the metal plate 10. Though not shown, the boss 30*c* is formed with a bore for receiving a screw or a pin.

Figure 12:
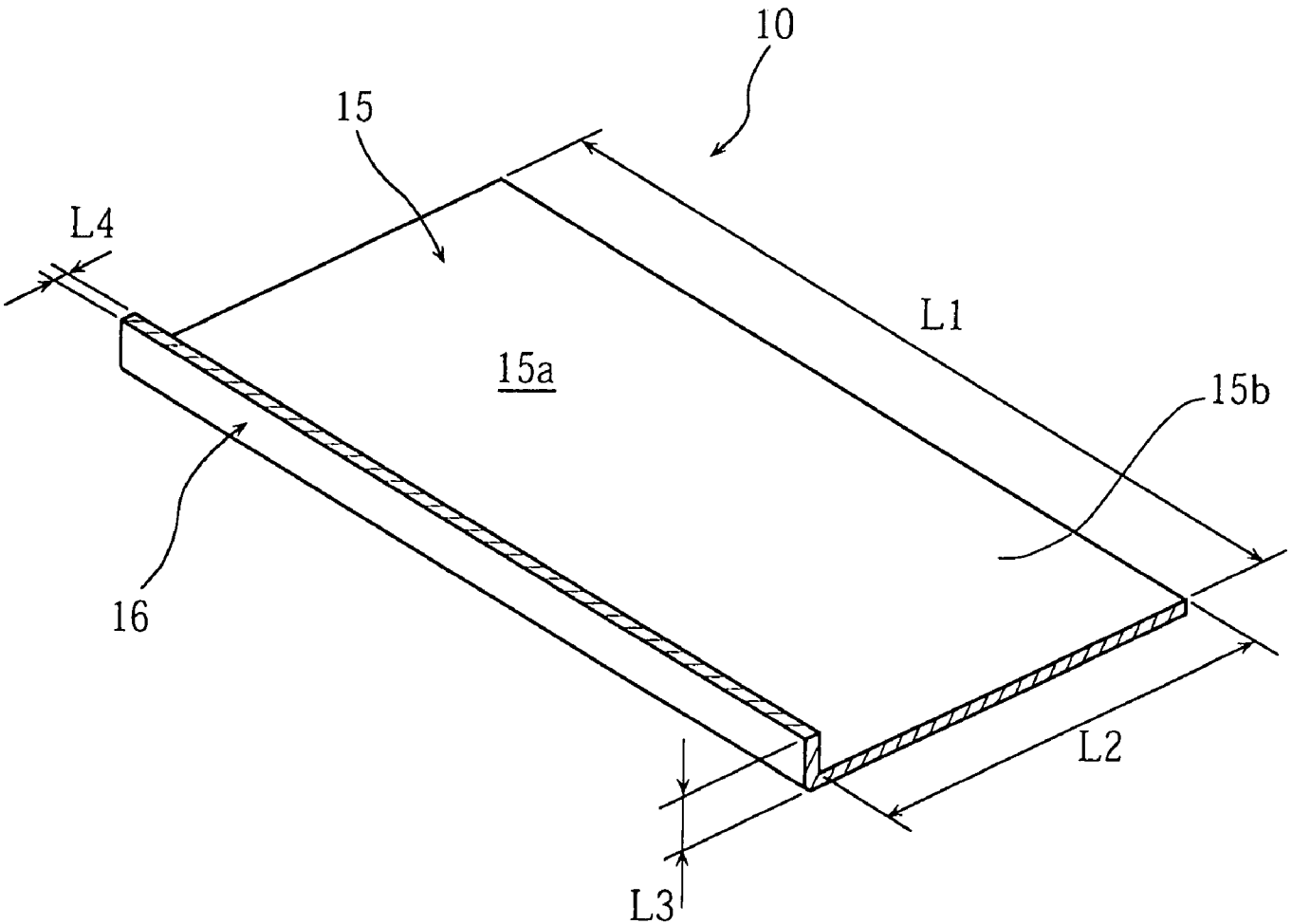
FIG. 12 is a perspective view showing a metal plate used for a third metal casting fabrication method of the present invention.

FIGS. 12~15 illustrate a third embodiment according to the present invention. FIG. 12 is a perspective view showing a metal plate 10 of the present embodiment. The plate 10 includes a broader primary portion 15 and a secondary portion 16 intersecting the primary portion at right angles. The primary portion 15 includes a first surface 15*a* and a second surface 15*b*. In the illustrated plate 10, the length L1 is 100 mm, the width L2 is 50 mm, the height L3 is 2.0 mm, and the thickness L4 is 0.3 mm. The plate 10 may be made of 99.999%-purity zinc (Zn).

Figure 13:
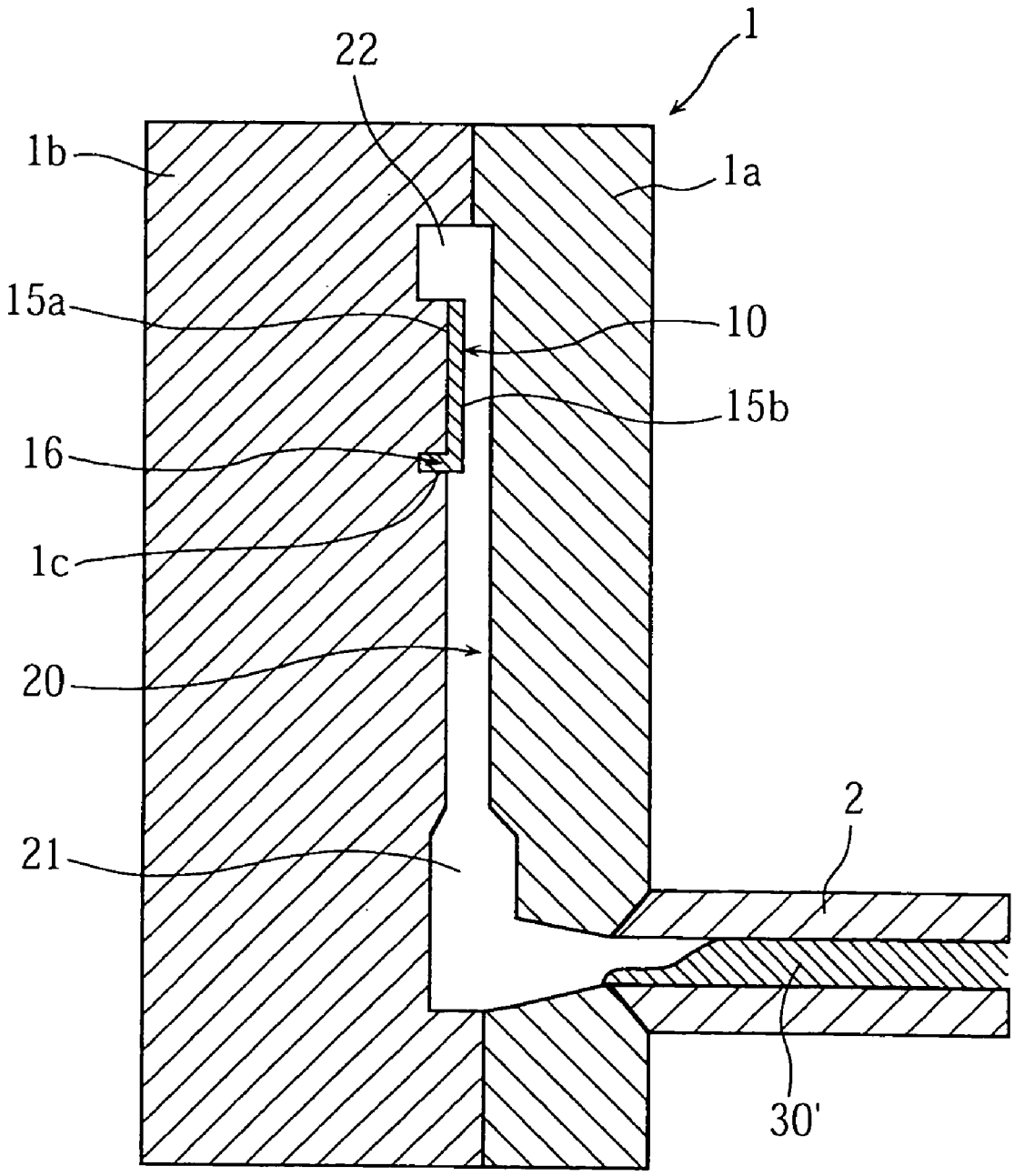
FIGS. 13 and 14 illustrate steps for making a metal casting of the third embodiment.

FIG. 13 is a sectional view showing a step of the metal casting fabrication method for the third embodiment. As illustrated, the metal plate 10 is clamped within the dies 1. At this stage, the first surface 15*a* of the primary portion 15 of the metal plate 10 comes into contact with the dies 1, while the second surface 15*b* is exposed to the cavity 20. The secondary portion 16 of the plate 10 is press-fitted into a groove 1*c* formed in an inner surface of the dies 1, so that the plate 10 is held stably by the dies 1. As shown, the cavity 20 includes a gate space 21 and an overflow space 22. Molten metal 30' is provided in the casting sleeve 2.

Figure 14:
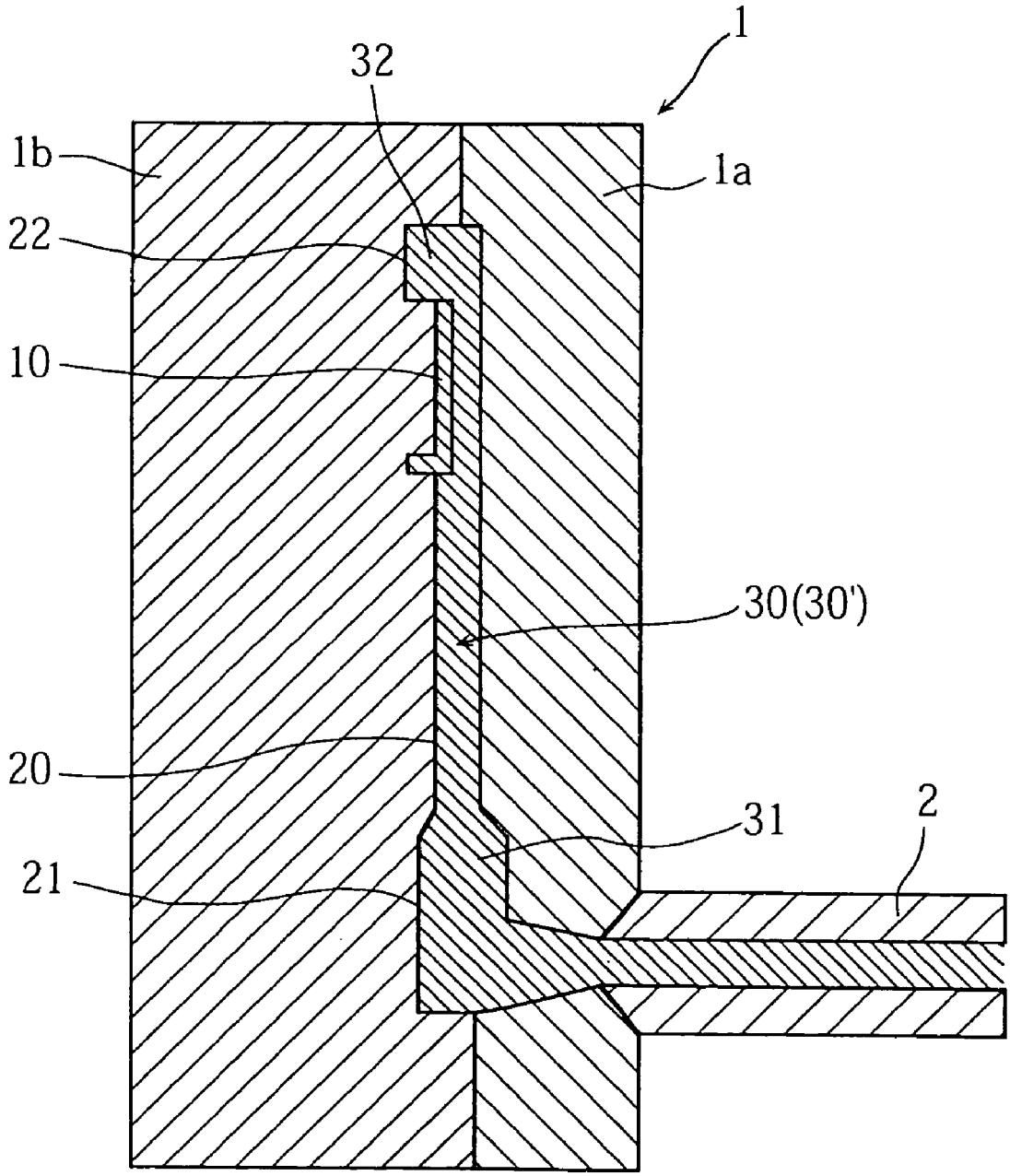

Referring to FIG. 14, the molten metal 30' is impelled under pressure into the cavity 20 by a plunger (not shown) slidably fitted in the sleeve 2. The metal 30' may be magnesium alloy such as AZ91D (which contains 9 wt % of aluminum, 1 wt % of zinc and 90 wt % of magnesium). The temperature of the dies 1 is kept between 150~300° C. in accordance with the kind of the metal 30'. The injected metal 30' reaches the metal plate 10 via the gate space 21. The plate 10, upon contacting with the heated metal 30', is partially melted into the metal 30'. Accordingly, the content of Zn in the metal 30' increases, which lowers the freezing point of the metal 30'. Owing to the lowered freezing point, the molten metal 30' can properly fill the overflow space 22. Thereafter, the metal 30' is solidified to provide a casting assembly P3', with the casting 30 incorporated therein. After the casting 30 is cooled sufficiently, the dies 1 are opened so that the assembly P3' can be taken out. At this stage, the metal plate 10 may or may not be left on the dies 1. In the former case, the plate 10 is absent on the assembly P3' taken out from the dies 1, while in the latter case, the plate 10 is present on the assembly P3'.

As readily understood, a desired number of additional casting assemblies can be produced by repeating the above-described steps.

Figure 15:
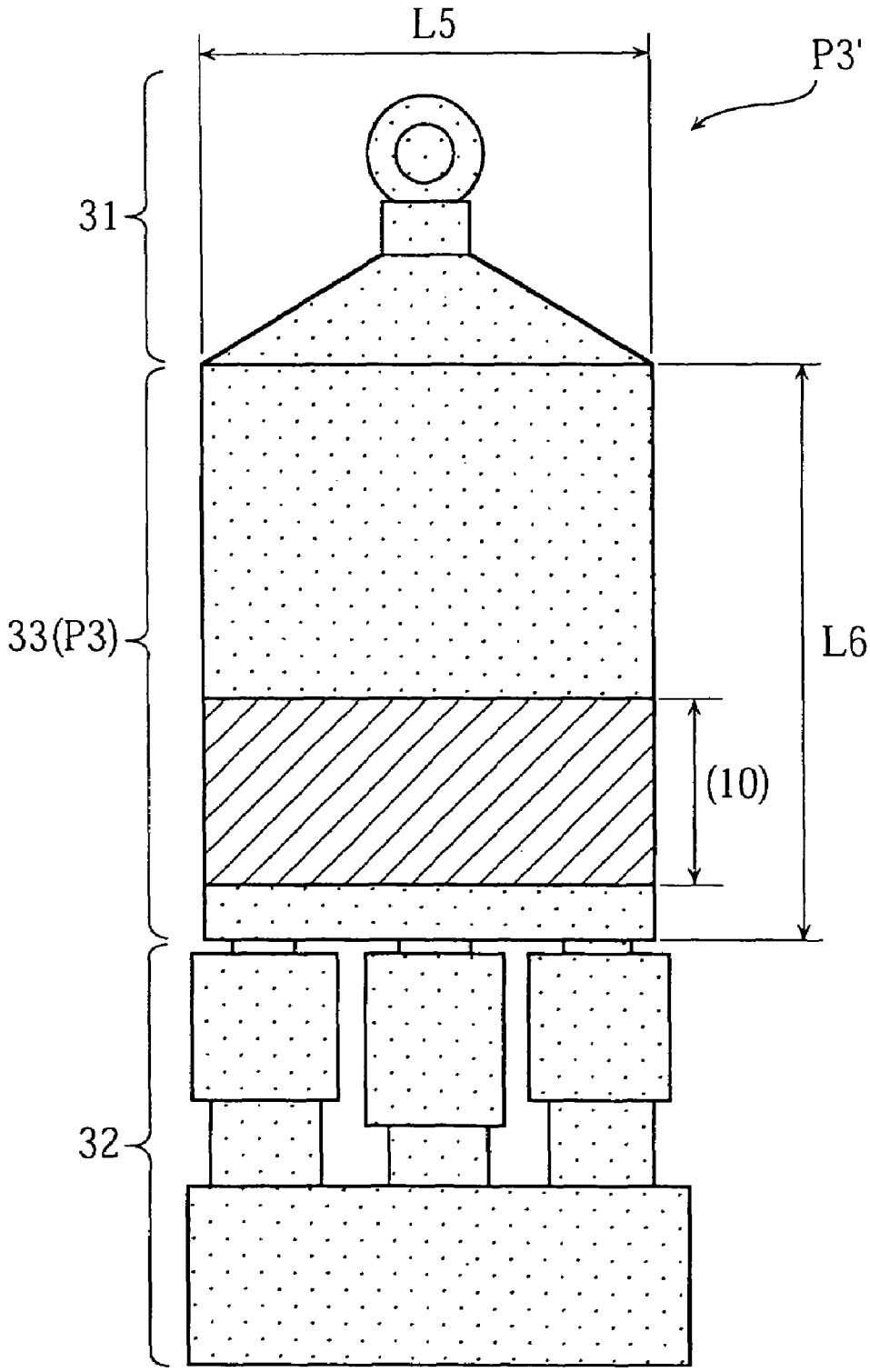
FIG. 15 is a plan view showing the metal casting of the third embodiment.

FIG. 15 is a plan view showing the casting assembly P3' of the third embodiment. As illustrated, the assembly P3' includes a gate portion 31 (corresponding to the above gate space 21), a product portion 33 (metal casting P3), and an overflow portion 32 (corresponding to the above overflow space 22). In the shaded region of the product portion 33, the metal plate 10 may or may not be present, as described above.

As shown in FIG. 15, the product portion 33 is located between the gate portion 31 and the overflow portion 32. In the illustrated embodiment, the width L5 of the product portion 33 is 100 mm, the length L6 is 150 mm, and the thickness is 0.8 mm. The gate portion 31 has a triangular configuration which results from the shape of the gate space 21. With such a flaring design, referring back to FIG. 13, the molten metal 30' is smoothly introduced into the cavity 20. The gate portion 31 and the overflow portion 32 will be cut off the product portion 33 at appropriate steps of the fabrication procedure.

According to the above method, the freezing point of the molten metal 30' is lowered by the partial melting of the metal plate 10 into the molten metal. In this manner, the flowability of the metal 30' can be maintained for a longer period of time than otherwise, which allows the metal 30' to fill a narrow space in the cavity 20.

In the above embodiment, the metal plate 10 is provided at the product portion 33, though the present invention is not limited to this. For instance, the plate 10 may be disposed at or adjacent to the boss 30*c*, rib 30*b* or any other suitable locations. Preferably, the plate 10 may be disposed upstream of a narrow space in the cavity. Further, the plate 10 is made of Zn in the above embodiment. However, the plate 10 may be made of aluminum alloy, magnesium alloy, zinc alloy or tin alloy when they are different in composition from the metal. 30' and contributes to lowering the freezing point of the metal 30'.

Examples of the present invention will now be described below with reference to comparative examples.

EXAMPLE 1

<Formation of Heat Insulating Layer>

To prepare dispersion liquid, 5 wt % of alumina powder (average particle diameter: 0.1 μm) and 40 wt % of adhesive agent (a mixture of casein, calcium hydroxide and sodium silicate) were added to water (dispersion medium). The obtained dispersion liquid was sprayed on an entire surface of an aluminum alloy plate (A5052P by Japanese Industrial Standard, or JIS) whose length is 180 mm, width 120 mm and thickness 0.5 mm. The applied dispersion liquid was blow-dried to form a heat insulating layer (having a thickness of 30 μm) on the metal plate.

<Die-Casting>

The formation of a casting was carried out by a die-casting machine. First, the above metal plate (with the heat insulating layer formed thereon) was held by projections of the female molding member of the dies. At this time, the insulating layer was held in contact with the dies, while the opposite surface to the insulating layer was exposed to the cavity. Then, the dies were clamped, and molten magnesium alloy (AZ91D by the ASTM standard) heated up to 650° C. was injected into the cavity. At this time, the temperature of the dies was 200° C., the injection pressure was 70 kgf/cm$^2$, and the injection rate was 2.5 m/s. The obtained metal casting assembly was subjected to formability and adhesiveness tests. Specifically, the formability is evaluated based on the filling rate of the molten metal at the thin-walled casting portion. The formability is better when there are a smaller number of defects such as blowholes and short runs in the thin-walled casting portion. In the table 1 given below, the symbol (○) indicates that the filling rate is greater than 98%, while the symbol (Δ) indicates that the filling rate is 90~98%. The adhesiveness is evaluated by the tensile test conducted with respect to the connecting region between the metal plate and the casting of the metal casting assembly. The specimen used for the test was a rectangular piece (10×10 mm) upon which the pulling test force was applied to the specimen in the direction perpendicular to the connecting plane between the metal plate and the casting. In the table 1 below, the symbol (○) indicates that the bonding strength is greater than 40 kgf/cm$^2$, the symbol (Δ) indicates that the bonding strength is 10~40 kgf/cm$^2$, and the symbol (x) indicates that the bonding strength is smaller than 10 kgf/cm$^2$.

EXAMPLE 2

A heat insulating layer (5 μm in thickness) was formed over an entire surface of an aluminum-alloy plate (A5052P by JIS) in the same manner as in Example 1 except that use was made of silica powder (average particle diameter: 0.01 μm) to prepare dispersion liquid in place of the alumina powder. Further, in the same manner as in Example 1, a casting was formed on the aluminum-alloy plate by die-casting to provide a metal casting assembly. The obtained assembly was subjected to formability and adhesiveness tests, as in Example 1. The results are shown in Table 1 below.

COMPARATIVE EXAMPLE 1

A heat insulating layer (50 μm in thickness) was formed over an entire surface of an aluminum-alloy plate (A5052P by JIS) in the same manner as in Example 1 except that use was made of graphite powder (average particle diameter: 20 μm) to prepare dispersion liquid in place of the alumina powder. Further, in the same manner as in Example 1, a casting was formed on the aluminum-alloy plate by die-casting to provide a metal casting assembly. The obtained assembly was subjected to formability and adhesiveness tests, as in Example 1. The results are shown in Table 1 below.

COMPARATIVE EXAMPLE 2

No heat insulating layer was formed on an aluminum-alloy plate (A5052P by JIS) whose dimensions are 120×180 mm in length and width and 0.5 mm in thickness. Under the same conditions as in Example 1, a casting was formed on the aluminum-alloy plate by die-casting, thereby providing a metal casting assembly. In the same manner as in Example 1, the assembly was subjected to formability test and adhesiveness test. The results are shown in Table 1 and Table 2 given below.

EXAMPLES 3 and 4

In Example 3, use was made of a magnesium-alloy plate (AZ31B by ASTM) whose dimensions are 120×180 mm in length and width and 0.5 mm in thickness. A heat insulating layer of alumina was formed on this Mg-alloy plate in the same manner as in Example 1. In Example 4, use was made of a magnesium-alloy plate (AZ31B by ASTM) whose dimensions are 120×180 mm in length and width and 0.5 mm in thickness. A heat insulating layer of silica was formed on this Mg-alloy plate in the same manner as in Example 2. Each of these alloy plates was formed with a casting by die-casting performed in the same manner as in Example 1. Thus, a metal casting assembly was obtained and subjected to formability test and adhesiveness test, as in Example 1. The results are shown in Table 1 below.

COMPARATIVE EXAMPLES 3 AND 4

In Comparative example 3, use was made of a magnesium-alloy plate (AZ31B by ASTM) whose dimensions are 120×180 mm in length and width and 0.5 mm in thickness. A heat insulating layer of graphite was formed on this Mg-alloy plate in the same manner as in Comparative example 1. In Comparative example 4, no heat insulating layer was formed on a magnesium-alloy plate (AZ31B by ASTM) whose dimensions are 120×180 mm in length and width and 0.5 mm in thickness. Each of these alloy plates was formed with a casting by die-casting performed in the same manner as in Example 1. Thus, a metal casting assembly was obtained and subjected to formability test and adhesiveness test, as in Example 1. The results are shown in Table 1 and Table 2 below.

EXAMPLES 5 and 6

In Example 5, use was made of a titanium-alloy plate (TP340C by JIS) whose dimensions 120×180 mm in length and width and 0.5 mm in thickness. A heat insulating layer of alumina was formed on this Ti-alloy plate in the same manner as in Example 1. In Example 6, use was made of a titanium-alloy plate (TP340C by JIS) whose dimensions 120×180 mm in length and width and 0.5 mm in thickness. A heat insulating layer of silica was formed on this Ti-alloy plate in the same manner as in Example 2. Each of these alloy plates was formed with a casting by die-casting performed in the same manner as in Example 1. Thus, a metal casting assembly was obtained and subjected to formability test and adhesiveness test, as in Example 1. The results are shown in Table 1 below.

COMPARATIVE EXAMPLES 5 AND 6

In Comparative example 5, use was made of a titanium-alloy plate (TP340C by JIS) whose dimensions 120×180 mm in length and width and 0.5 mm in thickness. A heat insulating layer of graphite was formed on this Ti-alloy plate in the same manner as in Comparative example 1. In Comparative example 6, no heat insulating layer was formed on a titanium-alloy plate (TP340C by JIS) whose dimensions 120×180 mm in length and width and 0.5 mm in thickness. Each of these alloy plates was formed with a casting by die-casting performed in the same manner as in Example 1. Thus, a metal casting assembly was obtained and subjected to formability test and adhesiveness test, as in Example 1. The results are shown in Table 1 below.

TABLE 1

| | Plate | Insulator | Formability | Adhesiveness |
|---|---|---|---|---|
| Example 1 | Al Alloy | Alumina | ○ | ○ |
| Example 2 | Al Alloy | Silica | ○ | ○ |
| Comparative example 1 | Al Alloy | Graphite | ○ | Δ |
| Comparative example 2 | Al Alloy | None | ○ | Δ |
| Example 3 | Mg Alloy | Alumina | ○ | ○ |
| Example 4 | Mg Alloy | Silica | ○ | ○ |
| Comparative example 3 | Mg Alloy | Graphite | ○ | Δ |
| Comparative example 4 | Mg Alloy | None | ○ | Δ |
| Example 5 | Ti Alloy | Alumina | ○ | ○ |
| Example 6 | Ti Alloy | Silica | ○ | ○ |

TABLE 1-continued

| | Plate | Insulator | Formability | Adhesiveness |
|---|---|---|---|---|
| Comparative example 5 | Ti Alloy | Graphite | Δ | ○ |
| Comparative example 6 | Ti Alloy | None | Δ | ○ |

Table 1 shows that the formation of a heat insulating layer made of alumina or silica on a light metal plate made of aluminum-, magnesium- or titanium-alloy is advantageous in the following two points. First, the formation of such a layer improves the formability of a casting to be formed on the metal plate. Second, it improves the adhesiveness between the casting and the metal plate.

EXAMPLE 7

<Formation of Heat Insulating Layer>

To prepare dispersion liquid, 20 wt % of alumina powder (average particle diameter: 0.1 μm) and 10 wt % of silicon dioxide (as adhesive agent) were added to water (as dispersion medium). The obtained dispersion liquid was sprayed onto an entire surface of an aluminum alloy plate (A5052 by JIS) whose dimensions are 120×180 mm in length and width and 0.5 mm in thickness. The applied liquid was blow-dried to form a heat insulating layer on the metal plate to the thickness of 30 μm.

<Formation of Bonding Layer>

The aluminum alloy plate has a surface to which the desired casting is to be attached. A ceramic coating agent was applied to this particular surface and thereafter dried. Thus, a bonding layer having a thickness of 50 μm was formed on the metal plate. The coating agent may be a ceramic coating material that contains silica-alumina-alkali metal. One example of such coating agents that are commercially available is "CERAMICA" produced by Nippan Kenkyujo Co.,Ltd.

<Die-Casting>

The formation of the casting was performed with the use of a die-casting machine. Specifically, after the metal plate was formed with the heat insulating layer and the bonding layer in the above-described manner, the metal plate was attached to the projections provided on the female molding member of the dies. At this time, the heat insulating layer was held in contact with the dies, while the bonding layer was exposed to the cavity. Then, the dies were clamped, and molten Mg alloy (AZ91D by ASTM, heated up to 650° C.) was injected into the cavity of the dies (heated up to 200° C.). The injection pressure was 70 kgf/cm$^2$, and the injection rate was 2.5 m/s. After the metal casting assembly was obtained, the "stability" of the casting was evaluated together with the above-defined formability and adhesiveness of the casting. Specifically, the evaluation of the stability was carried out in the following manner. First, the connecting region of the metal plate and the casting was divided into rectangular pieces (10 m×10 m). Then, each of these pieces was subjected to a tensile test for measuring the bonding strength between the metal plate and the casting. (In the test, the pulling force was applied perpendicularly to the joint surface.) After all the pieces had been tested, the specimens whose bonding strength was no smaller than 30 kgf/cm$^2$ was counted. Finally, the ratio (%) of the count to the total number of the rectangular pieces was calculated.

According to this evaluation system, the stability is higher as the calculated ratio is higher. In Table 2 given below, the symbol (◎) indicates that the calculated ratio is no smaller than 80%, the symbol (○) indicates that the calculated ratio is 50~80%, the symbol (Δ) indicates that the calculated ratio is 30~50%, and the symbol (x) indicates that the calculated ration is smaller than 30%.

EXAMPLE 8

The same method as in Example 7 was employed to prepare a metal plate except that the bonding layer formation was performed by electroless plating in place of the application of a ceramic coating agent. The thickness of the obtained bonding layer was 20 μm. The electroless plating was performed in the following manner. First, a chemical bath was prepared by mixing sodium hydrate (500 grams), zinc oxide (100 grams), iron chloride (1 gram) and potassium sodium tartrate (10 grams) into water (1 liter). Second, an aluminum-alloy plate was immersed in the bath for two minutes and then taken out. Finally, the metal plate was immersed once again in the bath for another two minutes.

After the plating, a casting was formed on the alloy plate, as in Example 7, by die-casting to provide a metal casting assembly. In the same manner as in Example 7, the casting assembly was subjected to formability, adhesiveness and stability tests. The results are shown in Table 2 below.

EXAMPLE 9

The same method as in Example 7 was employed to prepare a metal plate except that a bonding layer (100 μm in thickness) was formed on the metal plate by depositing carbon fiber on a polyimide film instead of applying a ceramic coating agent. Specifically, the bonding layer formation was carried out in the following manner.

First, the metal plate was subjected to defatting by an organic solvent and also to cleaning by acid or alkali. Then, a polyimide film was formed on the metal plate by a spin coat method. Finally, a sheet of carbon fiber ("TORAYCA" produced by Toray Industries, Inc.) was laid over the polyimide layer, and the metal plate with the fiber sheet was heated at 200° C. for 60 minutes in the atmosphere of argon gas. The carbon fiber sheet was prepared by immersing carbon fiber in an $SiCO_2$(15 wt %)-solution and then blow-drying the taken-out carbon fiber at 80° C. Subjected to this treatment, the carbon fiber was coated with a film well-reactive to the molten metal. (As a result, strong bonding between the metal plate and the casting (made of Mg alloy) can be secured.) After the bonding layer and the heat insulating layer were formed, the same die-casting method as in Example 7 was employed to form a casting on the above Al-alloy plate. Thus, the desired metal casting assembly was obtained. In the same manner as in Example 7, the casting assembly was subjected to formability, adhesiveness and stability tests. The results are shown in Table 2 below.

EXAMPLE 10

The same method as in Example 7 was employed to prepare a metal plate except that no bonding layer was formed. Further, as in Example 7, a casting was formed on the Al-alloy plate by die-casting, to provide a metal casting assembly. The thus obtained assembly was subjected to formability, adhesiveness and stability tests in the same manner as in Example 7. The results are shown in Table 2 below.

EXAMPLES 11, 12 and 13

In Example 11, the same method as in Example 7 was employed to prepare a metal plate (120×180 mm in length and width and 0.5 mm in thickness) except that this metal plate was made of magnesium alloy (AZ31B by ASTM), instead of aluminum alloy (A5052 by JIS). In Example 12, the same method as in Example 8 was employed to prepare a metal plate (120×180mm in length and width and 0.5 mm in thickness) except that this metal plate was made of magnesium alloy (AZ31B by ASTM), instead of aluminum alloy (A5052 by JIS). In Example 13, the same method as in Example 9 was employed to prepare a metal plate (120×180mm in length and width and 0.5 mm in thickness) except that this metal plate was made of magnesium alloy (AZ31B by ASTM), instead of aluminum alloy (A5052 by JIS). For each of the above three metal plates, a casting was formed in the same manner as in Example 7, thereby providing a metal casting assembly. Each of the thus obtained three casting assemblies was subjected to formability, adhesiveness and stability tests in the same manner as in Example 7. The results are shown in Table 2 below.

EXAMPLE 14

The same method as in Example 10 was employed to prepare a metal plate (120×180mm in length and width and 0.5 mm in thickness) except that this metal plate was made of magnesium alloy (AZ31B by ASTM), instead of aluminum alloy (A5052 by JIS). A casting was formed on the Mg-alloy plate by die-casting performed in the same manner as in Example 7. Thus, the desired metal casting assembly was obtained. This assembly was subjected to formability, adhesiveness and stability tests in the same manner as in Example 7. The results are shown in Table 2 below.

TABLE 2

| | Plate | Insulator | Bonding Layer | Form-ability | Adhe-siveness | Sta-bility |
|---|---|---|---|---|---|---|
| Example 7 | Al Alloy | Alumina | Ceramic | ○ | ○ | ○ |
| Example 8 | Al Alloy | Alumina | Zinc | ○ | ○ | ◎ |
| Example 9 | Al Alloy | Alumina | Glass | ○ | ○ | ○ |
| Example 10 | Al Alloy | Alumina | None | ○ | ○ | Δ |
| Comparative Example 2 | Al Alloy | None | None | ○ | Δ | X |
| Example 11 | Mg Alloy | Alumina | Ceramic | ○ | ○ | ○ |
| Example 12 | Mg Alloy | Alumina | Zinc | ○ | ○ | ◎ |
| Example 13 | Mg Alloy | Alumina | Glass | ○ | ○ | ○ |
| Example 14 | Mg Alloy | Alumina | None | ○ | ○ | Δ |
| Comparative Example 4 | Mg Alloy | None | None | ○ | Δ | X |

Table 2 shows that the bonding layer between the metal plate and the casting improves the bonding stability between them.

EXAMPLE 15

<Die-Casting>

Use was made of a zinc plate (99.999% of Zn purity; 100 mm of lenght; 50 mm of width; 2 mm of height [L3 in FIG. 12]; 0.3 mm of thickness). This plate was clamped in the dies of the die-casting machine. Molten Mg-alloy (AZ91D by ASTM) at a temperature of 630° C. was injected into the dies (whose temperature was 250° C.). The injection pressure was 70 kgf/cm$^2$, and the injection rate was 2.0 m/s. When the molten Mg-alloy came into contact with the metal plate in the cavity, all the Zn component of the plate was dissolved into the Mg-alloy. After sufficiently cooled, the obtained casting was taken out from the dies. In this manner, one hundred of sample castings were produced.

<Product Inspection>

The obtained samples were subjected to inspection to check out for visible defections (including misruns, cracks, chips, creases, ruggedness, etc.). This inspection showed that a zinc plate prevents a misrun.

COMPARATIVE EXAMPLE 7

Another one hundred of sample castings were produced in the same manner as in Example 15, except that the metal plate was not made of zinc. These samples were subjected to inspection to check out for visible defections, as in Example 15. This inspection showed that misruns occurred in 67 samples.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A metal casting comprising:

a metal plate including a first surface and a second surface opposite to the first surface;

a heat insulating layer formed on said first surface;

a molded member attached at least to said second surface; and a bonding layer disposed between said second surface and the molded member for improving bonding strength between the metal plate and the molded member;

wherein the heat insulating layer has a non-bonding surface located away from the metal plate, the non-bonding surface being entirely exposed; and wherein the molded member is held in contact with the heat insulating layer and has a surface that is flush with the exposed non-bonding surface of the heat insulating layer.

2. The metal casting according to claim 1, wherein the heat insulating layer dominantly contains a metal oxide selected from a group of aluminum oxide, silicon dioxide and magnesium oxide.

3. The metal casting according to claim 1, wherein the bonding layer is made of a metal selected from a group of aluminum, magnesium, titanium and zinc.

4. The metal casting according to claim 1, wherein the bonding layer is made of a ceramic material.

5. The metal casting according to claim 1, wherein the bonding layer contains a resin material and either one of a fibrous material and a porous material attached to the resin material.

6. The metal casting according to claim 1, wherein the molded member includes a functional portion attached at least to said second surface, the functional portion comprising at least one of a rib, a boss and a frame.

* * * * *